US011692417B2

(12) United States Patent
Rowaihy et al.

(10) Patent No.: US 11,692,417 B2
(45) Date of Patent: Jul. 4, 2023

(54) ADVANCED LATERAL ACCESSIBILITY, SEGMENTED MONITORING, AND CONTROL OF MULTI-LATERAL WELLS

(71) Applicant: Saudi Arabian Oil Company, Dhahran (SA)

(72) Inventors: Feras Hamid Rowaihy, Dhahran (SA); Suresh Jacob, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 88 days.

(21) Appl. No.: 17/103,407

(22) Filed: Nov. 24, 2020

(65) Prior Publication Data

US 2022/0162927 A1 May 26, 2022

(51) Int. Cl.
*E21B 43/12* (2006.01)
*E21B 43/14* (2006.01)
(Continued)

(52) U.S. Cl.
CPC ..... *E21B 43/12* (2013.01); *E21B 33/12* (2013.01); *E21B 34/06* (2013.01); *E21B 43/14* (2013.01);
(Continued)

(58) Field of Classification Search
CPC ..... E21B 43/12; E21B 33/12; E21B 43/14; E21B 43/305; E21B 49/0875; E21B 49/087
See application file for complete search history.

(56) References Cited

U.S. PATENT DOCUMENTS 5,706,892 A 1/1998 Aeschbacher, Jr. et al.
6,095,248 A 7/2000 Freeman
(Continued)

FOREIGN PATENT DOCUMENTS

EP 0937861 A2 8/1999
WO 2014124533 A1 8/2014
(Continued)

OTHER PUBLICATIONS

Bouldin et al., "Intelligent Completions in Laterals Becomes a reality", Society of Petroleum Engineers, SPE-183949-MS, 2017.
(Continued)

*Primary Examiner* — Catherine Loikith
(74) *Attorney, Agent, or Firm* — Bracewell LLP; Constance G. Rhebergen; Keith R. Derrington

(57) ABSTRACT

Methods and systems for producing fluids from a subterranean well include forming the subterranean well having at least one lateral wellbore. The lateral wellbore is completed with a lateral production tubular. The lateral wellbore is subdivided into subsequent lateral segments. Each lateral segment is defined by a downhole lateral packer and an uphole lateral packer that seal an annular lateral space defined by an outer diameter surface of the lateral production tubular and an inner diameter surface of the lateral wellbore. A main production tubular extends into the subterranean well, the main production tubular including a lateral access system that provides selective access to the lateral wellbore. A flow of a fluid within the lateral segment is controlled with an inflow control device of the lateral segment. The inflow control device is mechanically adjusted by a tool that is delivered to the inflow control device through the lateral access system.

14 Claims, 2 Drawing Sheets

(51) Int. Cl.

| | |
|---|---|
| ***E21B 49/08*** | (2006.01) |
| ***E21B 33/12*** | (2006.01) |
| ***E21B 34/06*** | (2006.01) |
| ***E21B 43/30*** | (2006.01) |
| ***E21B 47/04*** | (2012.01) |
| *E21B 7/04* | (2006.01) |

(52) U.S. Cl.
CPC ..... *E21B 43/305* (2013.01); *E21B 47/04* (2013.01); *E21B 49/0875* (2020.05); *E21B 7/046* (2013.01); *E21B 2200/06* (2020.05)

(56) References Cited

U.S. PATENT DOCUMENTS

| | | | | |
|---|---|---|---|---|
| 6,951,252 | B2 | 10/2005 | Restarick et al. | |
| 9,133,683 | B2 * | 9/2015 | Dyer | E21B 43/12 |
| 9,140,102 | B2 * | 9/2015 | Bartko | E21B 47/00 |
| 9,249,559 | B2 | 2/2016 | Dyer et al. | |
| 9,388,686 | B2 | 7/2016 | Konopczynski et al. | |
| 10,061,049 | B2 | 8/2018 | Arsalan et al. | |
| 10,132,159 | B2 | 11/2018 | Burgos | |
| 10,344,570 | B2 | 7/2019 | Steele | |
| 10,352,137 | B1 * | 7/2019 | Chen | E21B 43/12 |
| 10,774,625 | B2 * | 9/2020 | Noui-Mehidi | E21B 43/30 |
| 2004/0069487 | A1 | 4/2004 | Cook et al. | |
| 2009/0080291 | A1 | 3/2009 | Tubel et al. | |
| 2011/0042083 | A1 * | 2/2011 | Sierra | E21B 43/16 166/281 |
| 2013/0020088 | A1 | 1/2013 | Dyer et al. | |
| 2013/0255938 | A1 | 10/2013 | Neer | |

FOREIGN PATENT DOCUMENTS

| | | | |
|---|---|---|---|
| WO | 2016007165 | A1 | 1/2016 |
| WO | 2019059885 | A1 | 3/2019 |
| WO | 2019125410 | A1 | 6/2019 |

OTHER PUBLICATIONS

IsoRite®, "Isolated Multilateral Completion Systems", Completion Solutions, Multilateral Systems, Halliburton, 2018. Available at: https://www.halliburton.com/content/dam/ps/public/cps/contents/Data_Sheets/web/H/H02578.pdf.

Selective Lateral Intervention Completion System (SLIC) by Schlumberger, 2019. Available at: https://www.slb.com/completions/well-completions/multilaterals/selective-lateral-intervention-completion.

Stracke et al., "A New Concept for Multibranch Technology", Offshore Technology Conference, OTC-8539,1997, pp. 439-453.

International Search Report and Written Opinion for International Application No. PCT/US2021/060463, report dated May 6, 2022; pp. 1-14.

* cited by examiner

ADVANCED LATERAL ACCESSIBILITY, SEGMENTED MONITORING, AND CONTROL OF MULTI-LATERAL WELLS

BACKGROUND OF THE DISCLOSURE

1. Field of the Disclosure

The present disclosure relates to subterranean well development, and more specifically, the disclosure relates to systems for developing and producing dual-lateral wells.

2. Description of the Related Art

Often in the recovery of hydrocarbons from subterranean formations, wellbores are drilled with multiple highly deviated or horizontal portions that extend through separate hydrocarbon-bearing production zones. Each of the separate production zones can have distinct characteristics such as pressure, porosity and water content, which, in some instances, can contribute to undesirable production patterns.

During hydrocarbon production and management the occurrence of water breakthroughs constitutes an undesirable event because of the drop of oil-water ratio and the extra costs that could be incurred to rehabilitate the affected production wells. The water breakthrough may also imply changes in the properties of the reservoir, such as wettability and relative permeability that might be difficult to revert. The formation of water-flooding paths connecting injector and production wells can bypass sweet spots in the reservoir, rendering the stimulated production ineffective and ultimately leading to the abandonment of affected production wells due to non-economical water-oil-cut levels.

Alternately, an unwanted gas can be produced with the liquid hydrocarbons, making the combined hydrocarbon fluid difficult to produce to the surface and more costly to handle and refine.

As a separate matter, any workover involving entry into a branched lateral portion of a well can be lengthy, costly, and introduce risk due to uncertainties in entering the branched lateral portion. As an example, a workover can require the use of a workover rig or other specialize equipment and procedures to gain access to a lateral portion of a well.

SUMMARY OF THE DISCLOSURE

Embodiments of this disclosure provide well construction and completion methods and systems to integrate multilateral intelligent completions with mechanical sleeve inflow control devices in the lateral wellbores. A lateral access system enables rigless wireline and coil tubing access into each of the lateral wellbores. The lateral wellbores are subdivided into a number of lateral segments. Remote monitoring of each lateral segment is accomplished through wireless sensors or a tracer system. Fluid flow can be controlled at the lateral segment level by separate inflow control devices that are located within each lateral segment. The inflow control devices can be accessed through the lateral access system for mechanical adjustment. Logging operations can also be accomplished by passing a logging tool through the lateral access system.

In an embodiment of this disclosure, a method for producing fluids from a subterranean well includes forming the subterranean well having at least one lateral wellbore. The lateral wellbore is completed with a lateral production tubular that extends into the lateral wellbore. The lateral wellbore is subdivided into subsequent lateral segments, each lateral segment being defined by a downhole lateral packer and an uphole lateral packer. Each of the downhole lateral packer and the uphole lateral packer seal an annular lateral space defined by an outer diameter surface of the lateral production tubular and an inner diameter surface of the lateral wellbore. A main production tubular is extended into the subterranean well. The main production tubular includes a lateral access system that provides selective access to the lateral wellbore. A flow of a fluid within the lateral segment is controlled with an inflow control device of the lateral segment. The inflow control device is mechanically adjusted by a tool that is delivered to the inflow control device through the lateral access system.

In alternate embodiments, the lateral wellbore can be an open wellbore and the inner diameter surface of the lateral wellbore can be a subterranean formation. The flow of the fluids within the lateral segment can be monitored with a monitoring system of such lateral segment. A pressure of the fluids within the lateral segment can be monitored with the monitoring system of such lateral segment. A composition of the fluids within the lateral segment can be monitored with a monitoring system of such lateral segment.

In other alternate embodiments, a flow of a production fluid within the main production tubular and the flow of the production fluid in an annular space external of the main production tubular can be controlled with a control valve system, where the control valve system is secured in line with the main production tubular. Controlling the flow of the fluid within the lateral segment with the inflow control device of the lateral segment can include shifting a sleeve of the inflow control device. Logging operations can be performed in the lateral wellbore by a logging system that is delivered to the lateral wellbore through the lateral access system.

In an alternate embodiment of this disclosure, a method for producing fluids from a subterranean well includes forming the subterranean well having multiple lateral wellbores. Each of the multiple lateral wellbores is completed with a lateral production tubular that extends into an open bore of the lateral wellbore. Each of the multiple lateral wellbores is subdivided into subsequent lateral segments. Each lateral segment is defined by a downhole lateral packer and an uphole lateral packer. Each of the downhole lateral packer and the uphole lateral packer seal an annular lateral space defined by an outer diameter surface of the lateral production tubular and an inner diameter surface of the lateral wellbore. A main production tubular is extended into the subterranean well. The main production tubular includes a lateral access system that provides selective access to each of the multiple lateral wellbores. A flow of a fluid within each of the subsequent lateral segments is monitored for an amount of undesired fluid. The flow of the fluid within each of the subsequent lateral segments is controlled with an inflow control device of the lateral segment to reduce the amount of undesired fluid within a production fluid. The inflow control device of the lateral segment is mechanically adjusted by a tool that is delivered to the inflow control device through the lateral access system. Mechanical adjustment of the inflow control device of one of the lateral segments is independent of any adjustment of the inflow control device of any other of the lateral segments.

In yet another alternate embodiment of this disclosure, a system for producing fluids from a subterranean well include the subterranean well having at least one lateral wellbore. A lateral production tubular extends into the lateral wellbore. The lateral wellbore is subdivided into subsequent lateral segments. Each lateral segment is defined by a downhole lateral packer and an uphole lateral packer. Each of the downhole lateral packer and the uphole lateral packer seal an annular lateral space defined by an outer diameter surface of the lateral production tubular and an inner diameter surface of the lateral wellbore. A main production tubular extends into the subterranean well. The main production tubular includes a lateral access system that provides selective access to the lateral wellbore. An inflow control device of the lateral segment is operable to control a flow of a fluid within the lateral segment with. The inflow control device is mechanically adjustable by a tool that is delivered to the inflow control device through the lateral access system.

In alternate embodiments, the lateral wellbore can be an open wellbore and the inner diameter surface of the lateral wellbore can be a subterranean formation. The lateral segment can include a monitoring system operable to monitor the flow of the fluids within the lateral segment. The lateral segment can alternately include a monitoring system operable to monitor a pressure of the fluids within the lateral segment. The lateral segment can alternately include a monitoring system operable to monitor a composition of the fluids within the lateral segment.

In other alternate embodiments, the system can further include a control valve system, where the control valve system can be secured in line with the main production tubular. The control valve system can be operable to control a flow of a production fluid within the main production tubular and to control the flow of the production fluid in an annular space external of the main production tubular. The inflow control device of the lateral segment can include a sleeve that is shiftable to control the flow of the fluid within the lateral segment. A logging system can be delivered to the lateral wellbore through the lateral access system and can be operable to perform logging operations in the lateral wellbore.

BRIEF DESCRIPTION OF THE DRAWINGS

So that the manner in which the features, aspects and advantages of the embodiments of this disclosure, as well as others that will become apparent, are attained and can be understood in detail, a more particular description of the disclosure may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

As used in this Specification, the term "substantially equal" means that the values being referenced have a difference of no more than two percent of the larger of the values being referenced.

Where reference is made in the specification and appended Claims to a method comprising two or more defined steps, the defined steps can be carried out in any order or simultaneously except where the context excludes that possibility.

Figure 1:
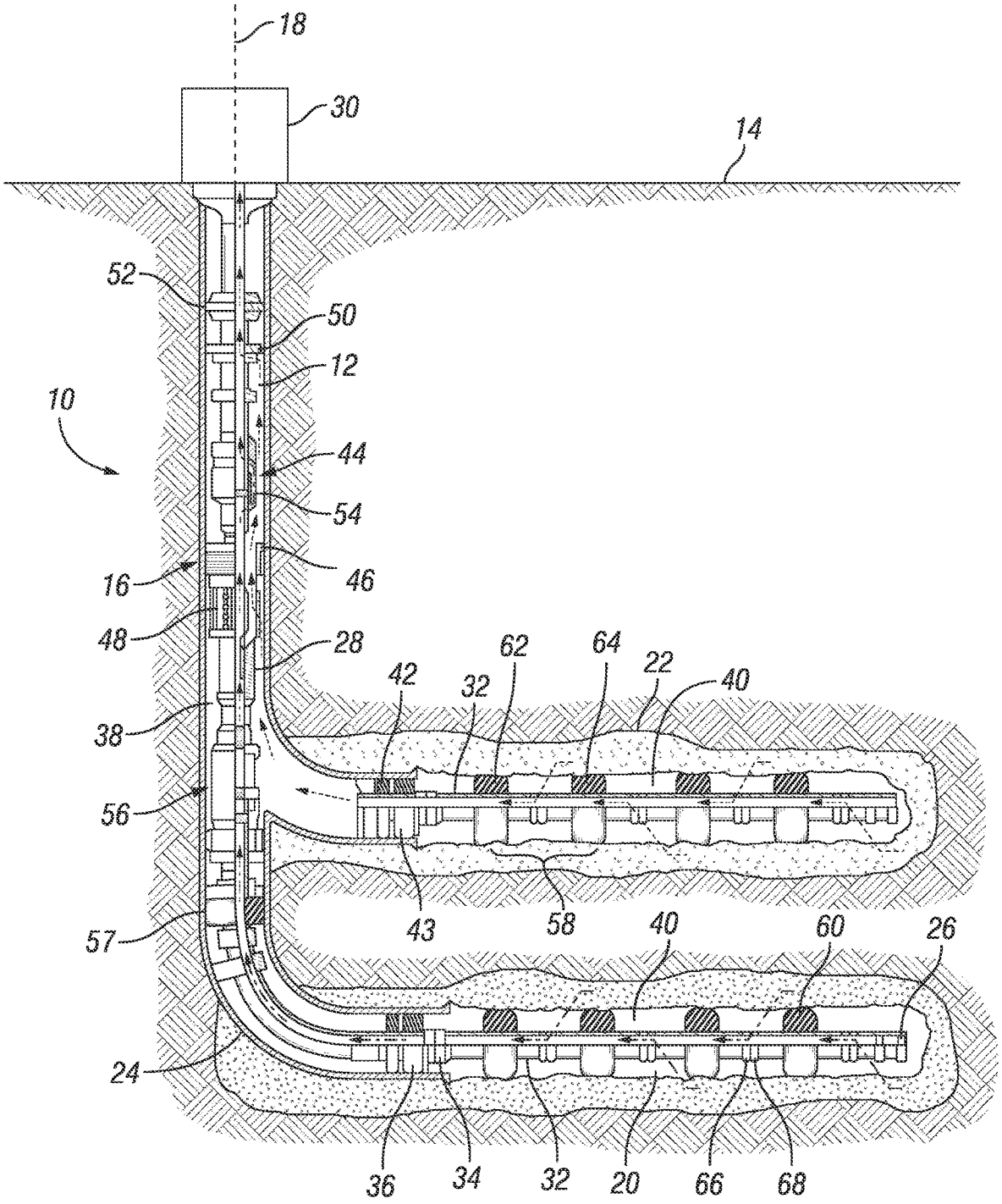
FIG. 1 is a schematic sectional view of a subterranean well with a hydrocarbon development system in accordance with an embodiment of this disclosure.

Looking at FIG. 1, subterranean well 10 can have wellbore 12 that extends to an earth's surface 14. Wellbore 12 can be drilled from surface 14 and into and through various formation zones of subterranean formations. Subterranean well 10 can be an offshore well or a land based well and can be used for producing hydrocarbons from a subterranean hydrocarbon reservoir.

Subterranean well 10 includes a main wellbore 16 with a central axis 18. Main wellbore 16 can be a generally vertical well bore as shown in FIG. 1, or can be angled relative to the plane of the surface 14. Subterranean well 10 can further include lower lateral wellbore 20 and upper lateral wellbore 22, each having a heel 24 and a toe 26. Lower lateral wellbore 20 and upper lateral wellbore 22 can extend from main wellbore 16 in a direction generally horizontally. In the embodiment of FIG. 1, two lateral wellbores are shown. In alternate embodiments there can be one lateral wellbore or more than two lateral wellbores.

Main production tubular 28 can extend into subterranean well 10 through main wellbore 16. Main production tubular 28 can extend from earth's surface 14 and can provide a flow path for producing production fluids to the surface. The production fluids can include fluids that are delivered from the hydrocarbon reservoirs by way of lower lateral wellbore 20 and upper lateral wellbore 22. The production fluids can be delivered to a surface system 30 for further handling, transportation, refining, or storage.

Each of the lateral wellbores, such as lower lateral wellbore 20 and upper lateral wellbore 22, can be completed with lateral production tubular 32. Lateral production tubular 32 extends into each of the lateral wellbores.

Lateral production tubular 32 is in fluid communication with main production tubular 28. Looking at FIGS. 1-2, lateral production tubular 32 of lower lateral wellbore 20 can be secured to a downhole end of main production tubular 28. As an example, lateral production tubular 32 of lower lateral wellbore 20 can be connected to the downhole end of main production tubular 28 by way of liner hanger 34 and seal assemblies. In such a system, the inner bore of the lower lateral production tubular 32 of lower lateral wellbore 20 is in direct fluid communication with the inner bore of main production tubular 28 through tubing section in 24.

Lower packer assembly 36 can circumscribe main production tubular 28 proximate to the downhole end of main production tubular 28. Lower packer assembly 36 can seal annular space 38 external of main production tubular 28 and defined by the outer diameter surface of main production tubular 28 and the inner diameter surface of wellbore 12 so that fluids cannot travel between lower lateral wellbore 20 and annular space 38. In particular fluids within annular lateral space 40 of lower lateral wellbore 20 can only enter main wellbore 16 by way of entering lateral production tubular 32 of lower lateral wellbore 20 and traveling within the bore of lateral production tubular 32 to the bore of main production tubular 28.

Lateral production tubular 32 of upper lateral wellbore 22 can be secured within wellbore 12 by way of upper hanger assembly 42. Upper hanger assembly 42 can include a liner hanger so that the inner bore of lateral production tubular 32 of upper lateral wellbore 22 is in direct fluid communication with annular space 38.

Upper hanger assembly 42 can further include upper packer 43. Upper packer 43 can circumscribe lateral production tubular 32 of upper lateral wellbore 22. Upper packer 43 can seal against the inner diameter surface of wellbore 12 so that fluids cannot travel between upper lateral wellbore 22 and annular space 38 past upper packer 43. In particular fluids within annular lateral space 40 of upper lateral wellbore 22 can only enter main wellbore 16 by way of entering lateral production tubular 32 of upper lateral wellbore 22 and traveling within the bore of lateral production tubular 32 to annular space 38.

In order to isolate one or more of the lateral wellbores or control the rate of fluid produced from one or more of the wellbores, control valve system 44, which includes inlet valve 50 and main control valve 54 can be secured in line with main production tubular 28. Control valve system 44 is a lateral access and isolation system. Main control valve 54 can control the flow of the production fluid from the lower lateral while inlet valve 50 controls the flow from upper laterals. Both inlet valve 50 and main control valve 54 can be remotely operated from the surface and has multiple choke setting to control the operation and rate of flow from each lateral independently.

The lateral access and isolation system of control valve system 44, can further include one or more control packers 46. Control packer 46 can seal across annular space 38 uphole of the junction of main wellbore 16 with the lateral wellbore, downhole of the junction of main wellbore 16 with the lateral wellbore. In alternate embodiments, a first control packer 46 can be located uphole of the junction of main wellbore 16 with the lateral wellbore, and a second control packer 46 can be located downhole of the junction of main wellbore 16 with the lateral wellbore. In embodiments with addition lateral wellbores, a control packer 46 can be located between each lateral wellbore. Each of the control packers 46 seal across annular space 38 so that fluids within annular space 38 cannot travel within annular space 38 past the control packer 46.

The lateral access and isolation system of control valve system 44 can further include a packer bypass valve 48 to allow flow from the lateral. Packer bypass valve 48 can be, for example, a perforated pipe or a sliding sleeve valve. Packer bypass valve 48 is associated with a control packer 46 that is used to secure the lateral access system 56 in the correct location. Packer bypass valve 48 can be a mechanical valve and can provide a fluid flow path for a fluid within annular space to travel within annular space 38 past control packer 46. Isolation packer 57 is located between lateral access system 56 and lower packer assembly 36 provides fluid isolation between the lower later and upper lateral.

Figure 2:
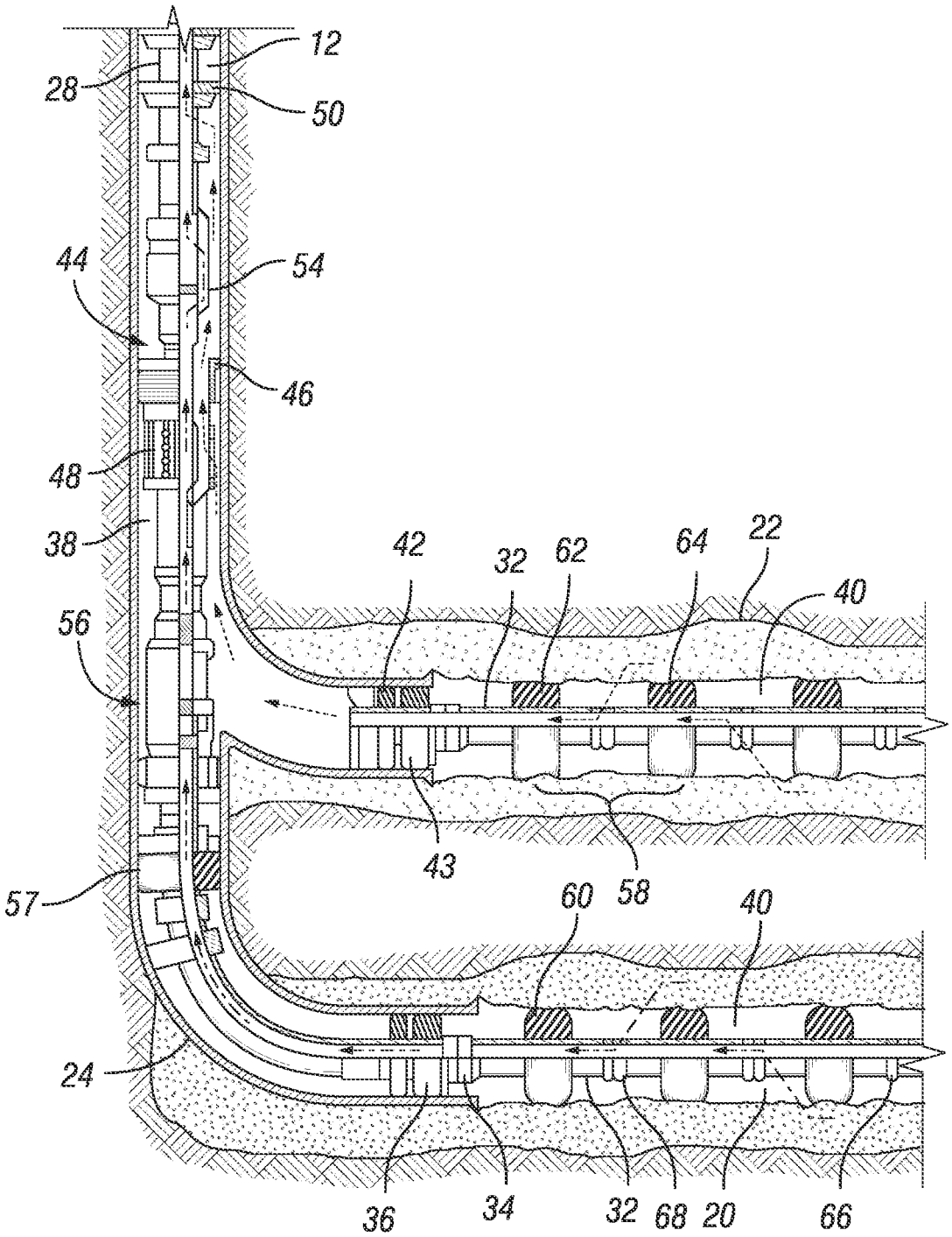
FIG. 2 is a schematic detailed sectional view of a wellbore of a subterranean well with a hydrocarbon development system in accordance with an embodiment of this disclosure.

As shown in FIG. 2, fluid that is produced from the upper lateral wellbore can travel uphole within annular space 38, through packer bypass valve 48 past control packer 46, and into annular space 38 uphole of control packer 46. The produced fluid can then enter main production tubular 28 through inlet valve 50. Inlet valve 50 can be remotely controlled from the surface to control the rate of flow from the upper lateral. When inlet valve 50 is in the closed position, fluids from upper lateral wellbore 22 cannot flow into main production tubular 28. Inlet valve 50 can have positions between fully open and fully closed and can be adjusted to such positions to control the rate of flow of fluid from upper lateral within annular space 38 traveling through packer bypass valve 48.

Main control valve 54 provides a fluid flow path between the lower lateral and the bore of main production tubular 28. Inlet valve 50 allows for fluid produced from upper lateral wellbore 22 to enter the bore of main production tubular 28. Main packer 52 can seal annular space 38 so that the fluids within annular space 38 cannot travel uphole of main packer 52 and must instead enter main production tubular 28 to be produced to the surface.

In order to control the flow of the production fluids within main production tubular 28, control valve system 44 further includes main control valve 54 and inlet valve 50. Main control valve 54 can be a smart valve that can be operated remotely from the surface. Main control valve 54 can be a wired or a wireless device.

In the open position, main control valve 54 will allow fluid from the lower lateral to main production tubular 28 to travel through the bore of main production tubular 28 past main control valve 54. In the closed position, main control valve 54 will block fluid within main production tubular 28 from traveling through the bore of main production tubular 28 past main control valve 54. Main control valve 54 can have multiple intermediate positions between fully open and fully closed to control inflow from the lower lateral and can be remotely adjusted from surface without well intervention to such positions to control the rate of flow of fluid from lower lateral to main production tubular 28 traveling past main control valve 54.

The features of control valve system 44 provides an intelligent completion features that can be used to control the flow of fluids at the lateral level. That is, control valve system 44 can control the rate of flow of fluids being produced from each lateral wellbore.

There may be times after completion of subterranean well 10 that mechanical access to one of the lateral wellbores is desired. In the example embodiments of FIGS. 1-2, lateral access system 56 is included in line with main production tubular 28 to provide selective access to upper lateral wellbore 22 from main production tubular 28.

The lateral access system includes features to accurately align the tubing window with the casing window. This alignment between the tubing window and casing window is critical to allow an intervention tool that is run through main production tubular 28 to enter into a lateral. The lateral access tubing window can include an internal nipple profile to secure an isolation sleeve to prevent fluid from the lateral entering through the tubing window. This isolation sleeve can divert the fluid from the lateral into the annular space, through the packer bypass valve 48, and then to the inlet valve 50.

In use, lateral access system 56 can be operated to allow a tool to be riglessly delivered from main production tubular 28, through an open window of lateral access system 56, and into the bore of upper lateral wellbore 22. Lateral access system 56 can include a directing member, such as a tubing whipstock, that will help to direct the tool through the window of lateral access system 56 and into upper lateral wellbore 22. The tool can further be lowered into the bore of lateral production tubular 32 and extend through lateral production tubular 32. As an example, a production logging tool or inflow control device adjustment tool can be delivered into lateral production tubular 32 on a wireline or coiled tubing through lateral access system 56.

In embodiments of this disclosure, each lateral wellbore can be subdivided into subsequent lateral segments 58 by a series of lateral packers 60. Each lateral segment 58 is defined between uphole lateral packer 62 and downhole lateral packer 64. Because the lateral segments 58 are adjacent, an uphole lateral packer 62 of one of the lateral segments 58 can be a downhole lateral packer 64 of an adjacent lateral segment 58. Similarly, a downhole lateral packer 64 of one of the lateral segments 58 can be an uphole lateral packer 62 of an adjacent lateral segment 58.

Each of the downhole lateral packers 64 and uphole lateral packers 62 seal annular lateral space 40. Annular lateral space 40 is defined by an outer diameter surface of lateral production tubular 32 and an inner diameter surface of the lateral wellbore. In the example embodiment of FIGS. 1-2, the lateral wellbores are open wellbores and the inner diameter surface of the lateral wellbore is a subterranean formation. In alternate embodiments, the lateral wellbores can be lined with a liner, for example with a casing or other tubular member, and the inner diameter surface of the lateral wellbore is the liner.

In the example embodiment of FIG. 1, there are four lateral packers 60 in each lateral wellbore, defining three lateral segments 58 in each lateral wellbore. A fourth lateral segment of each lateral wellbore is defined between the downhole-most lateral packer 60 and toe of 26 of each lateral wellbore. In alternate embodiments there can be as many as forty lateral segments 58. Depending on the type of formation, lateral segments 58 may be short as 100 ft to as long as 2500 ft.

Each lateral segment 58 includes a separate inflow control device 66. Inflow control device 66 can control a flow of fluid that travels into lateral production tubular 32 from the lateral wellbore of lateral segment 58. Inflow control device 66 can provide a fluid flow path into lateral production tubular 32 from the portion of the lateral wellbore of lateral segment 58. As an example, the production entrance of inflow control device 66 may be in the form of a screen or perforations. The inflow control devices 66 in each compartment can alternately have a sliding sleeve that can be opened and closed to control inflow from each compartment.

Each inflow control device 66 can be mechanically adjusted by a tool that is delivered to inflow control device 66 through lateral access system 56. As an example, a tool can be lowered into the bore of main production tubular 28, through lateral access system 56, and into the bore of lateral production tubular 32. The tool can then extend to inflow control device 66.

As an example, inflow control device 66 can have a sleeve that can be shifted by the mechanical tool. The shifting of the sleeve can adjust the rate of the flow of fluids through inflow control device 66, for example by covering and uncovering openings that provide the fluid flow path between lateral production tubular 32 and annular lateral space 40 of lateral segment 58.

The rate and fluid phase from each lateral segment 58 is monitored through wireless or chemical sensors to estimate oil, water and gas rate from each lateral segment 58. Each lateral segment 58 includes a separate monitoring system 68. Monitoring system 68 can include, for example, a flow monitor unit, a pressure sensor unit, a fluid composition monitor unit, and any combination of such units. Monitoring system 68 can therefore monitor a flow rate of the fluids within lateral segment 58, a pressure of the fluids within lateral segment 58, a composition of the fluids within lateral segment 58, and any combination of such functions.

Monitoring system 68 can be a wireless system that can be remotely monitored by an operator at the surface. Wireless pressure, temperature and fluid monitoring sensors may be placed in each lateral segment 58 for performing monitoring operations. Alternately, monitoring system 68 can be a tracer system. Unique oil, water and gas tracers can be placed in the annulus of each lateral segment 58. Fluid samples are collected and analyzed at the surface to identify any lateral segment 58 with water and gas that should be closed by stopping lateral access or by closing inflow control device 66, such as by sleeve shifting. Chemical tracers allow downhole monitoring without well intervention in laterals and without downhole cables for regular permanent downhole sensors.

Monitoring system 68 can identify the compartments with undesirable fluid, such as compartments with high water or gas ratios. The high water or gas production will can be associated with a particular lateral segment 58. With this information, an operator has the ability to close or choke back the inflow control device 66 of such lateral segment 58 mechanically using wireline or coil tubing access into lateral production tubular 32. The inflow control device 66 of the other lateral segments 58 of the lateral wellbore can be unchanged. In this way, fluid flow into the lateral segment 58 with the high water or gas ratio can be stopped or reduced while production of fluids through other lateral segments 58 of the same lateral wellbore can continue.

In an example of operation, subterranean well 10 is drilled and completed with multiple lateral wellbores sidetracked from the main wellbore 8. Each lateral wellbore is completed with lateral packers 60 defining separate lateral segments 58. Each lateral segment includes a separate monitoring system 68 and separate inflow control device 66. During production the performance of each lateral segment 58 is remotely monitored and lateral segments 58 with high water or gas are identified and tracked. When water or gas ratios reach a predetermined threshold, smart well valves can be remotely operated to reduce drawdown from the whole lateral wellbore to reduce the production of water or gas. If the lateral level control does not sufficiently reduce the water or gas production, then wireline or coil tubing can be mobilized to riglessly access the applicable lateral wellbore and choke back fluid flow from the offending lateral segment 58.

Embodiments of this disclosure therefore provide compartment or segment level monitoring and control in multilateral wells. Such monitoring of a water breakthrough will reduce the need for conventional logging. However, if conventional logging is desired, logging operations in any lateral wellbore can be performed by a logging system that is delivered to the lateral wellbore through lateral access system 56.

If a water breakthrough or a high water or gas ratio is detected, systems and method of the current application can extend well life by mechanical shut off of only the offending lateral segment, while continuing to produce from adjacent sections within the same lateral wellbore. The inflow rate from each lateral can be optimized to reduce coning and delay water breakthrough. Embodiments of this disclosure provide a finer and more precise level of monitoring and control within lateral wellbores compared to a current practice of controlling the whole lateral wellbore from the junction of the lateral wellbore and the main wellbore.

Embodiments of this disclosure, therefore, are well adapted to carry out the objects and attain the ends and advantages mentioned, as well as others that are inherent. While embodiments of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for producing fluids from a subterranean well, the system including:

the subterranean well having at least one lateral wellbore;

a lateral production tubular that extends into the lateral wellbore, where the lateral wellbore is subdivided into subsequent lateral segments, each lateral segment being defined by a downhole lateral packer and an uphole lateral packer, each of the downhole lateral packer and the uphole lateral packer sealing an annular lateral space defined by an outer diameter surface of the lateral production tubular and an inner diameter surface of the lateral wellbore;

a main production tubular extending into the subterranean well, the main production tubular including a lateral access system that provides selective access from a bore of the main production tubular, through the lateral access system, to the lateral wellbore;

a control valve in the main production tubular that is controlled based on monitoring characterisitics of fluid in the lateral segments; and an inflow control device of the lateral segment operable to control a flow of a fluid within the lateral segment; where the inflow control device is mechanically adjustable by accessing the inflow control device through the lateral access system.

2. The system of claim 1, where the lateral wellbore is an open wellbore and the inner diameter surface of the lateral wellbore is a subterranean formation.

3. The system of claim 1, where the lateral segment includes a monitoring system operable to monitor the flow of the fluids within the lateral segment.

4. The system of claim 1, where the lateral segment includes a monitoring system operable to monitor a pressure of the fluids within the lateral segment.

5. The system of claim 1, where the lateral segment includes a monitoring system operable to monitor a composition of the fluids within the lateral segment.

6. The system of claim 1, further including a control valve system, where the control valve system is secured in line with the main production tubular, the control valve system operable to control a flow of a production fluid within the main production tubular and to control the flow of the production fluid in an annular space external of the main production tubular.

7. The system of claim 1, where the inflow control device of the lateral segment includes a sleeve that is shiftable to control the flow of the fluid within the lateral segment.

8. The system of claim 1, further including a logging system that is delivered to the lateral wellbore through the lateral access system and is operable to perform logging operations in the lateral wellbore.

9. A method for producing fluids from a subterranean well, the method including:

forming the subterranean well having multiple lateral wellbores;

completing each of the multiple lateral wellbores with a lateral production tubular that extends into an open bore of the lateral wellbore;

subdividing each of the multiple lateral wellbores into subsequent lateral segments, each lateral segment being defined by a downhole lateral packer and an uphole lateral packer, each of the downhole lateral packer and the uphole lateral packer sealing an annular lateral space defined by an outer diameter surface of the lateral production tubular and an inner diameter surface of the lateral wellbore;

extending a main production tubular into the subterranean well, the main production tubular including a lateral access system that provides selective access from a bore of the main production tubular, through the lateral access system, to each of the multiple lateral wellbores;

monitoring a flow of a fluid within each of the subsequent lateral segments for an amount of undesired fluid;

controlling a main production flow based on the step of monitoring, and controlling the flow of the fluid within each of the subsequent lateral segments with an inflow control device of the lateral segment to reduce the amount of undesired fluid within a production fluid; where the inflow control device of the lateral segment is mechanically adjusted by accessing the inflow control device through the lateral access system; and mechanical adjustment of the inflow control device of one of the lateral segments is independent of any adjustment of the inflow control device of any other of the lateral segments.

10. A method for producing fluids from a subterranean well, the method including:

forming the subterranean well having at least one lateral wellbore;

completing the lateral wellbore with a lateral production tubular that extends into the lateral wellbore;

subdividing the lateral wellbore into subsequent lateral segments, each lateral segment being defined by a downhole lateral packer and an uphole lateral packer, each of the downhole lateral packer and the uphole lateral packer sealing an annular lateral space defined by an outer diameter surface of the lateral production tubular and an inner diameter surface of the lateral wellbore;

extending a main production tubular into the subterranean well, the main production tubular including a lateral access system that provides selective access from a bore of the main production tubular, through the lateral access system, to the lateral wellbore;

monitoring one or more of a flow, a pressure, or a composition of the fluid that is within the lateral segment;

controlling a flow of the fluid within the lateral segment by mechanically adjusting an inflow control device of the lateral segment that is accessed through the lateral access system; and controlling a flow of production fluid within the main production tubular based on monitoring the fluid within the lateral segment.

11. The method of claim 10, where the lateral wellbore is an open wellbore and the inner diameter surface of the lateral wellbore is a subterranean formation.

12. The method of claim 10, further including controlling the flow of the production fluid in an annular space external of the main production tubular with a control valve system, where the control valve system is secured in line with the main production tubular.

13. The method of claim 10, where controlling the flow of the fluid within the lateral segment with the inflow control device of the lateral segment includes shifting a sleeve of the inflow control device.

14. The method of claim 10, further including performing logging operations in the lateral wellbore by a logging system that is delivered to the lateral wellbore through the lateral access system.

* * * * *